US007704084B1

(12) United States Patent
Cheng

(10) Patent No.: US 7,704,084 B1
(45) Date of Patent: Apr. 27, 2010

(54) USB CONNECTOR EXTENSION/RETRACTION DEVICE FOR USB FLASH DRIVE

(76) Inventor: Chieh-Yu Cheng, No. 90 Guang Ming Road, Jheng Yi Li Neighborhood 8, Lu Jhou City, Taipei Hsien (TW)

( * ) Notice: Subject to any disclaimer, the term of this patent is extended or adjusted under 35 U.S.C. 154(b) by 0 days.

(21) Appl. No.: 12/385,334

(22) Filed: Apr. 6, 2009

(51) Int. Cl.
*H01R 13/44* (2006.01)

(52) U.S. Cl. ..... 439/131

(58) Field of Classification Search ..... 439/131, 439/66

See application file for complete search history.

(56) References Cited

U.S. PATENT DOCUMENTS

| | | | | |
|---|---|---|---|---|
| 6,743,030 | B2 * | 6/2004 | Lin et al. | 439/131 |
| 7,295,431 | B2 * | 11/2007 | Chuang | 361/679.55 |
| 7,303,411 | B1 * | 12/2007 | Morganstern et al. | 439/131 |
| 7,307,849 | B2 * | 12/2007 | Ho et al. | 361/737 |
| 7,361,032 | B2 * | 4/2008 | Loftus | 439/131 |
| 7,416,423 | B2 * | 8/2008 | Chi et al. | 439/131 |
| 7,524,198 | B2 * | 4/2009 | Nguyen et al. | 439/131 |
| 7,558,069 | B2 * | 7/2009 | Chung | 361/737 |
| 7,558,070 | B2 * | 7/2009 | Kang | 361/752 |
| 2002/0137375 | A1 * | 9/2002 | Wagatsuma et al. | 439/131 |
| 2003/0103369 | A1 * | 6/2003 | Wu | 365/131 |
| 2004/0063346 | A1 * | 4/2004 | Lin et al. | 439/131 |
| 2006/0099837 | A1 * | 5/2006 | Cheng et al. | 439/131 |
| 2008/0076280 | A1 * | 3/2008 | Chi et al. | 439/131 |
| 2008/0081493 | A1 * | 4/2008 | Oh | 439/131 |
| 2008/0160803 | A1 * | 7/2008 | Morganstern et al. | 439/131 |

* cited by examiner

*Primary Examiner*—T C Patel
*Assistant Examiner*—Vladimir Imas
(74) *Attorney, Agent, or Firm*—Rosenberg, Klein & Lee

(57) ABSTRACT

An improved USB connector extension/retraction device for a USB flash drive includes a moving cover for coupling with a flash memory unit (which has a USB connector), a resilient bar element, and two springs. The moving cover is assembled with a railed housing to form the USB connector extension/retraction device. The moving cover can be pushed forward and secured in position so that the USB connector of the flash memory unit is extended out for use. When not in use, the USB connector is retracted automatically so as to be hidden for protection. In addition, the USB connector extension/retraction device allows the USB flash drive to have a reduced volume.

1 Claim, 7 Drawing Sheets

USB CONNECTOR EXTENSION/RETRACTION DEVICE FOR USB FLASH DRIVE

BACKGROUND OF THE INVENTION

1. Technical Field

The present invention relates to USB flash drives and, more particularly, to an improved USB connector extension/retraction device for protecting a USB connector of a USB flash drive.

2. Description of Related Art

As computer technology continuously improves and evolves, computer peripherals are also enhanced in design so as to have increased efficiency and reduced volume for high portability.

Nowadays, USB flash drives are the mainstream of portable storage devices for use with computers. USB flash drives are highly popular because of their large storage capacities and small volumes, which translates to increased portability. A USB flash drive typically has a USB connector to be inserted into and thus coupled with a computer so as to transmit, read, and write data to and from the computer. However, the USB connector protrudes from the main body of the USB flash drive and may be damaged when the USB flash drive is dropped to the ground. Therefore, referring to FIG. 1, a commercially available USB flash drive 10 has a protective structural design based on back-and-forth movement and composed mainly of a cover 20 provided around the main body of the USB flash drive 10 such that the main body of the USB flash drive 10 can move back and forth inside the cover 20 and be secured in place for protection. More specifically, by pushing a rear end of the main body of the USB flash drive 10, the main body is moved forward so as to be secured at a predetermined position, and in consequence a USB connector 101 of the USB flash drive 10 is exposed outside the cover 20 for insertion into a computer. When the rear end of the main body of the USB flash drive 10 is pushed again, the main body, which is biased by a spring, retracts automatically so as to hide the USB connector 101 inside the cover 20 for protection.

While the aforesaid structure is capable of protecting the USB connector 101, a good number of components are involved so that the volume of the USB flash drive 10 as well as the labor and cost required for assembly is increased. Hence, the USB flash drive 10 is undesirably thick and cannot be reduced in length.

BRIEF SUMMARY OF THE INVENTION

In view of the aforementioned drawbacks of the conventional protective structure for USB flash drives, the inventor of the present invention put years of experience in the related industry into simplifying the components of a USB flash drive so as to reduce cost and save labor during production, downsize the USB flash drive for enhanced portability, and protect the USB connector by means of retraction. After extensive research and repeated trials, an improved structure for protecting the USB connector is finally obtained and disclosed herein.

The present invention relates to an improved USB connector extension/retraction device for a USB flash drive, wherein the USB connector extension/retraction device includes a moving cover for coupling with a flash memory unit (which has a USB connector), a resilient bar element, and two springs. The moving cover is assembled with a railed housing to form the USB connector extension/retraction device. The moving cover can be pushed forward and secured in position so that the USB connector of the flash memory unit is extended out for use. When not in use, the USB connector is retracted automatically so as to be hidden for protection. Furthermore, the USB connector extension/retraction device allows the USB flash drive to have a reduced volume.

It is a first objective of the present invention to retract and hide the USB connector of a USB flash drive for protection and downsize the USB flash drive for enhanced portability.

It is a second objective of the present invention to simplify the components of a USB flash drive so as to facilitate assembly and lower the defective ratio.

BRIEF DESCRIPTION OF THE SEVERAL VIEWS OF THE DRAWINGS

The invention as well as a preferred mode of use, further objectives, and advantages thereof will be best understood by referring to the following detailed description of an illustrative embodiment in conjunction with the accompanying drawings, wherein.

DETAILED DESCRIPTION OF THE INVENTION

Figure 1:
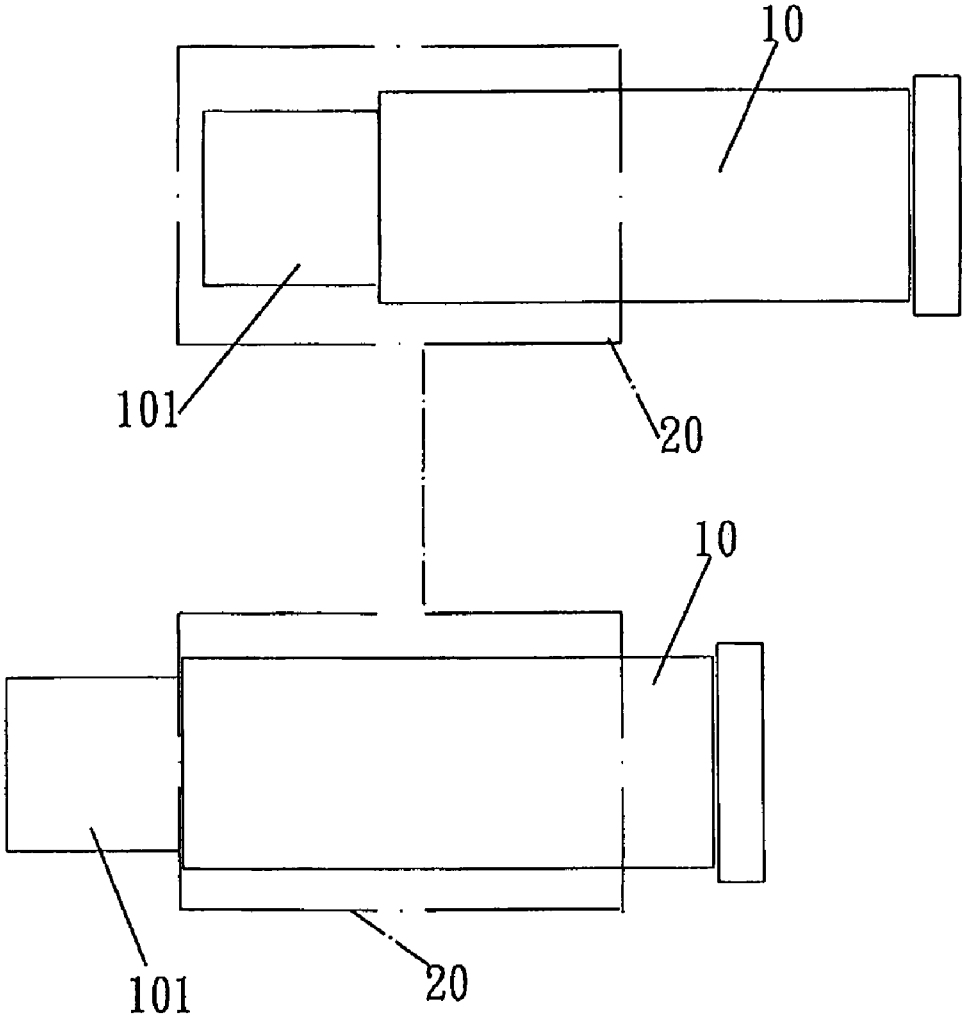
FIG. 1 (PRIOR ART )
FIG. 1 schematically shows a conventional USB flash drive having a cover capable of back-and-forth movement so as to protect a USB connector of the USB flash drive.
Figure 2:
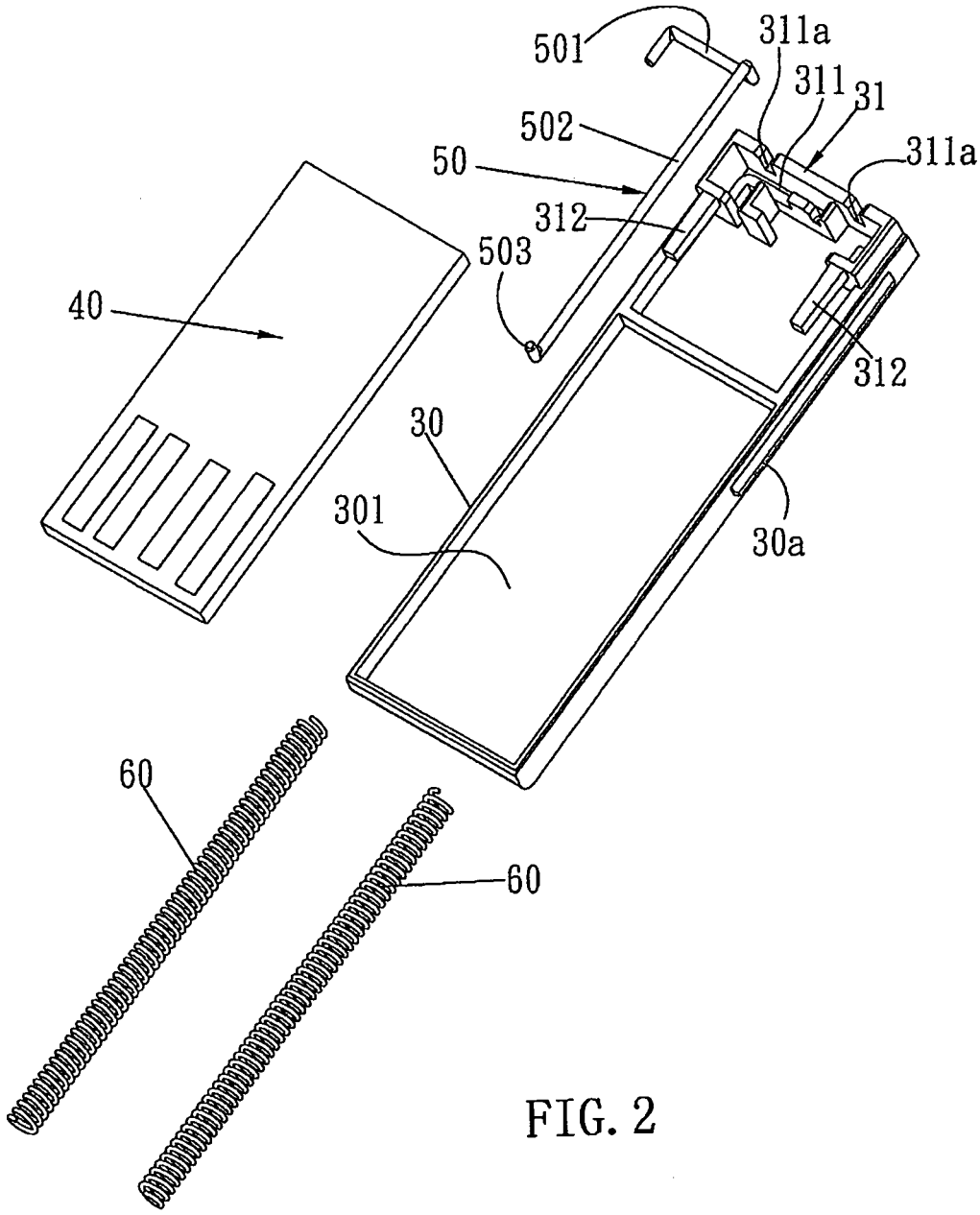
FIG. 2 is a perspective view of a moving cover according to the present invention accompanied by a flash memory unit, a resilient bar element, and two springs yet to be coupled with the moving cover.
Figure 3:
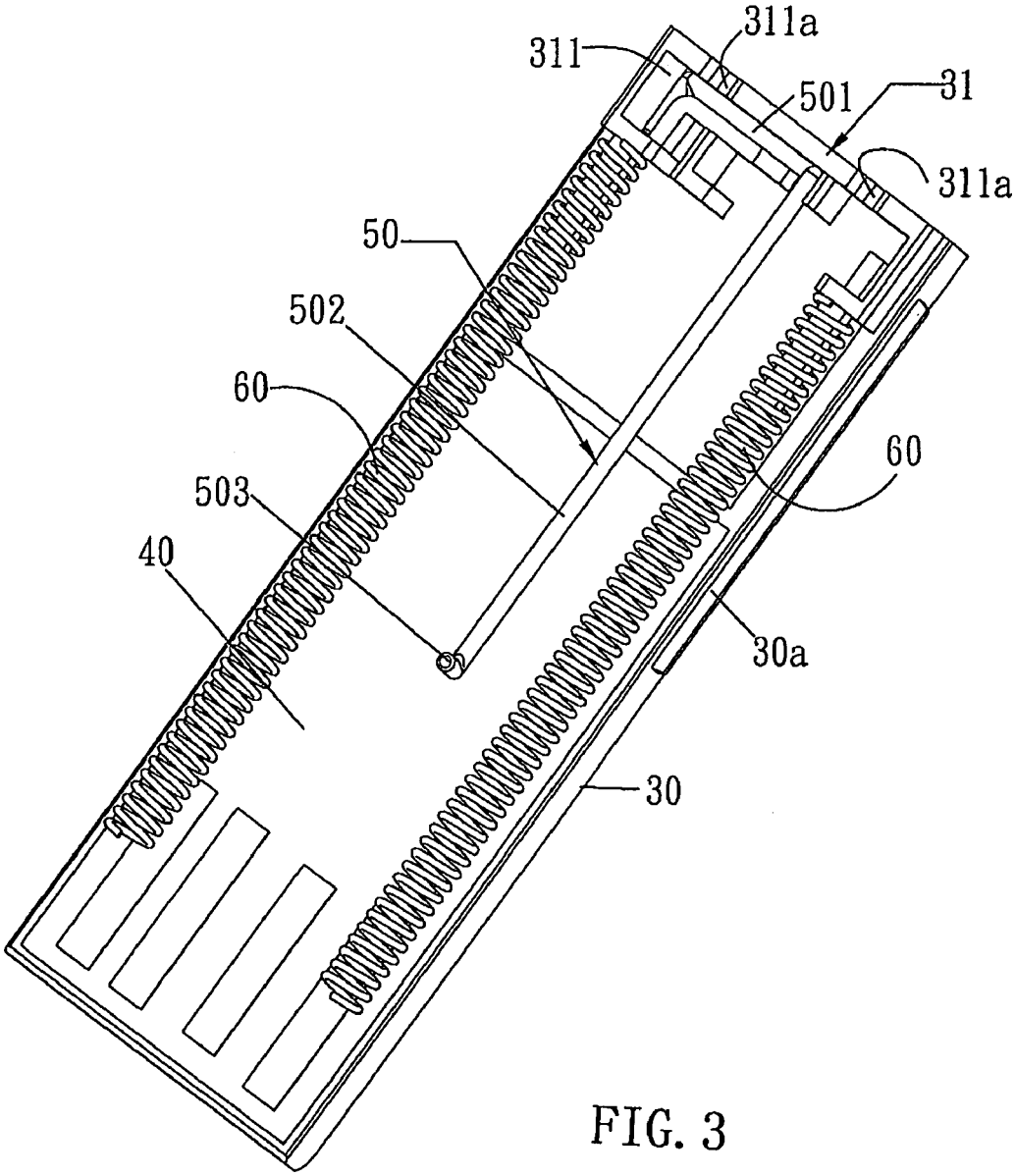
FIG. 3 is a perspective view of the moving cover according to the present invention coupled with the flash memory unit, the resilient bar element, and the two springs.
Figure 4:
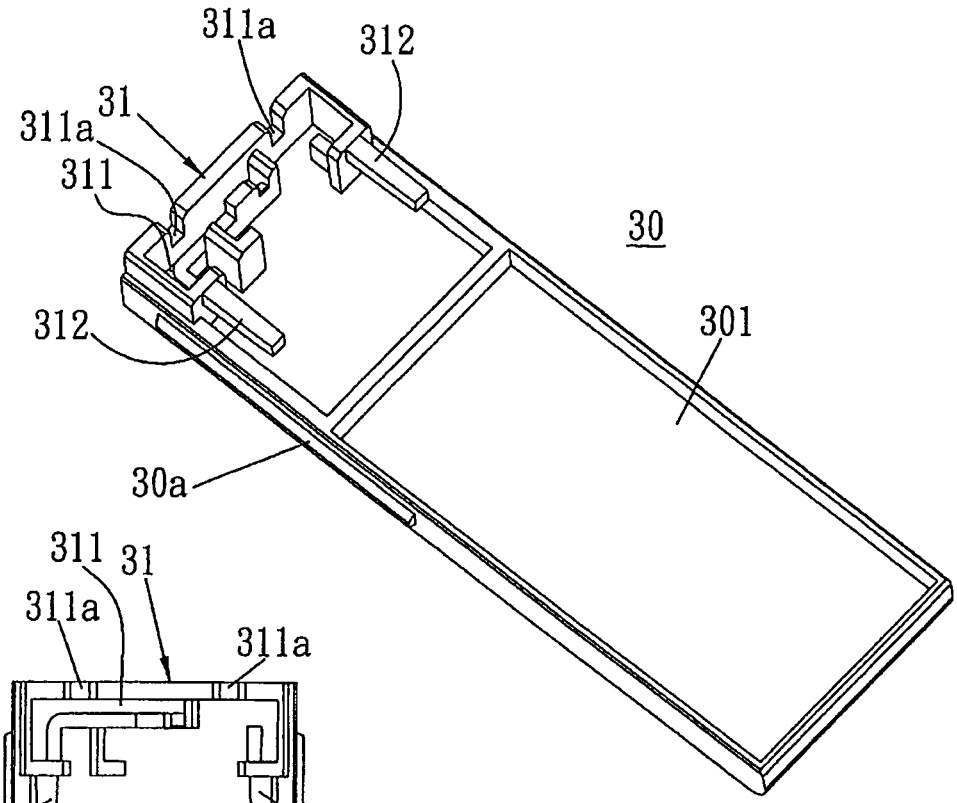
FIG. 4 is a perspective view of the moving cover according to the present invention.
Figure 5:
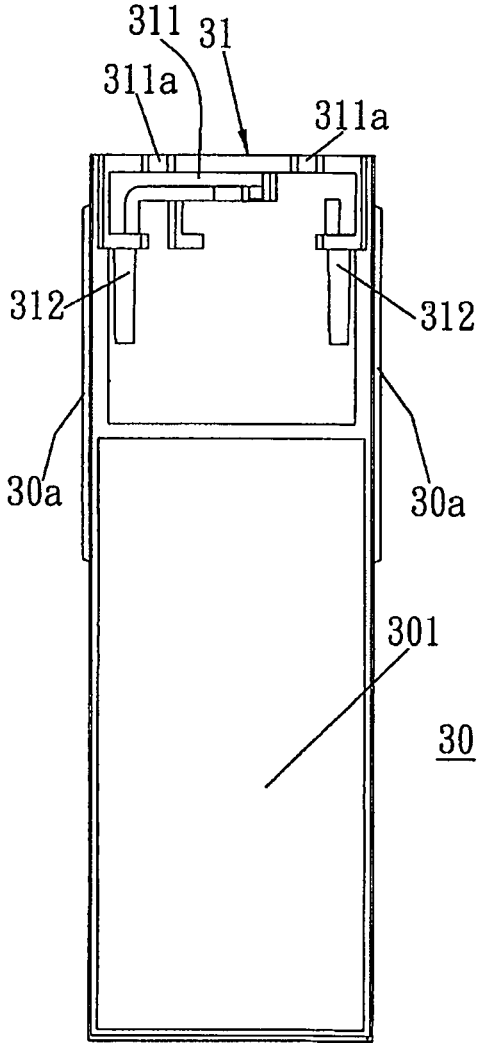
FIG. 5 is a top view of the moving cover according to the present invention.
Figure 6:
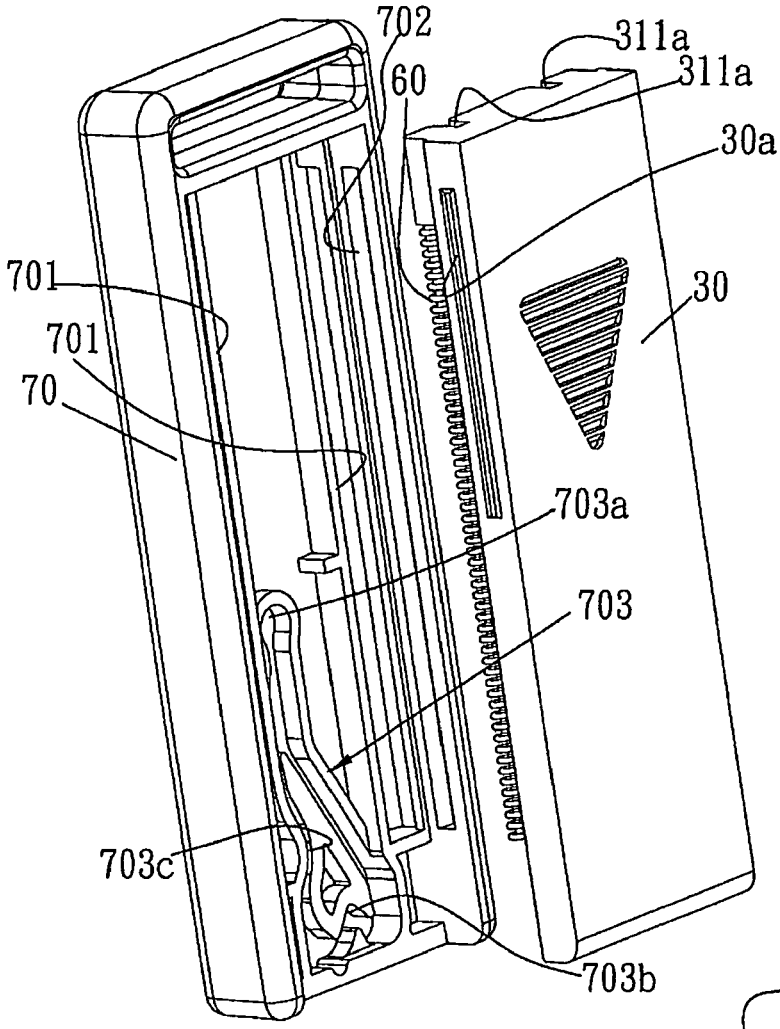
FIG. 6 is a perspective view of the moving cover according to the present invention coupled with the flash memory unit, the resilient bar element, and the two springs and accompanied by a railed housing yet to be assembled with the moving cover.
Figure 6A:
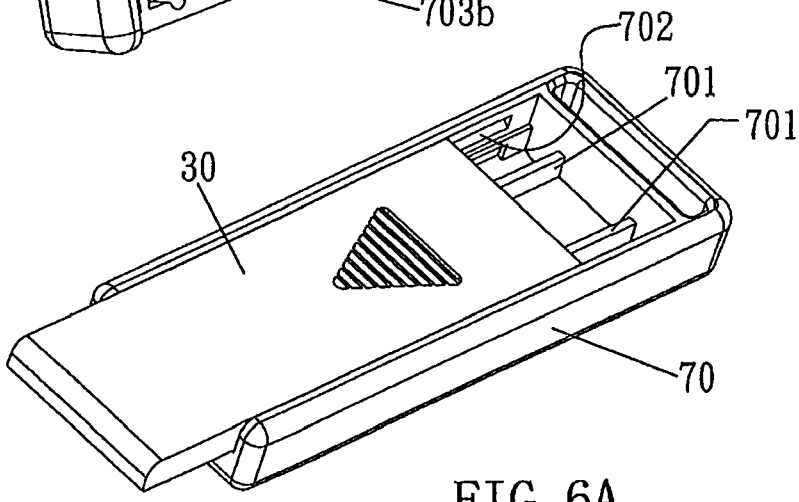
FIG. 6A is a perspective view of a USB connector extension/retraction device for a USB flash drive according to the present invention.
Figure 7:
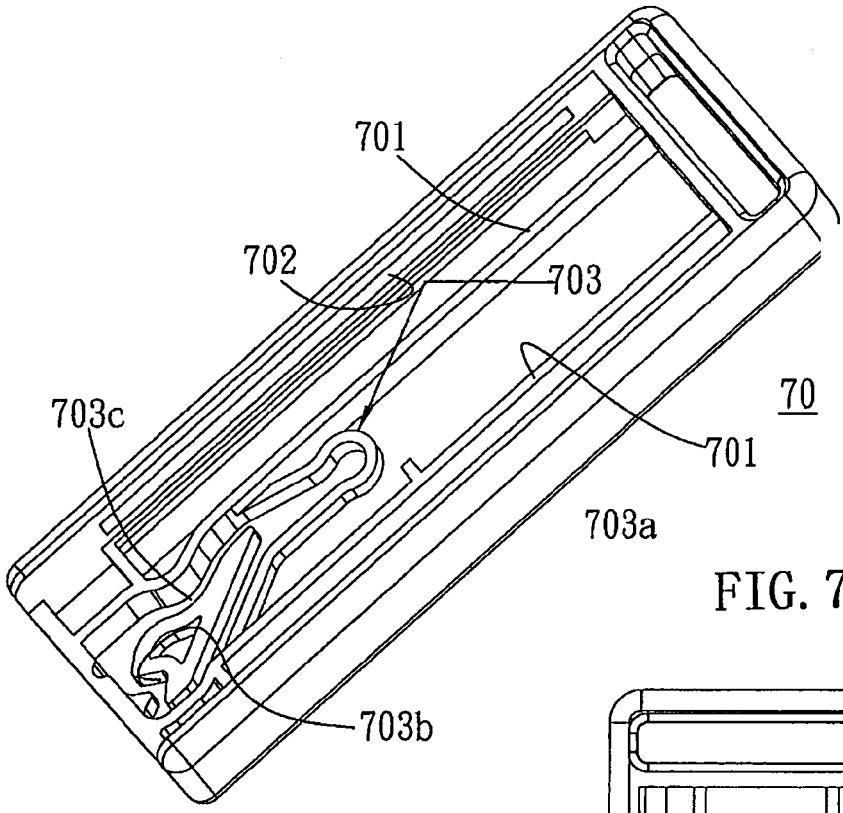
FIG. 7 is a perspective view of the railed housing according to the present invention.

FIG. 2 and FIG. 3 show a moving cover yet to be coupled, or already coupled, with a flash memory unit, a resilient bar element, and two springs according to the present invention. Referring to FIGS. 2 and 3 in conjunction with FIG. 4 and FIG. 5, a moving cover 30 has two sidewalls each protrudingly provided with a raised rail 30*a*. The moving cover 30 also has a front end formed with a cavity 301 for receiving a flash memory unit 40. In addition, an insertion-based retaining unit 31 is provided behind the cavity 301 and has a rear end formed with two notches 311*a* and a groove 311. The groove 311 is configured for being inserted by, and in turn retaining, an insertion portion 501 of a resilient bar element 50. Also, the insertion-based retaining unit 31 is bilaterally provided with protruding posts 312 for inserting into and thus retaining springs 60, respectively. Referring to FIGS. 6, 7, 8, and 9, a railed housing 70 is internally formed with a recess and has two sidewalls each concavely provided with recessed rail 702 for engaging with a corresponding one of the raised rails 30*a* of the moving cover 30 so that the raised rails 30*a* can move back and forth in the recessed rails 702, respectively. The railed housing 70 is also protrudingly provided therein with two raised rails 701 which are spaced from each other and configured for engaging with the two notches 311*a* of the insertion-based retaining unit 31 of the moving cover 30 so that the raised rails 701 can move back and forth in the notches 311*a*, respectively. Further, a generally Y-shaped track 703 is provided at a front end in between the two raised rails 701 and configured for guiding a hooked tip 503 at a front end of a resilient bar 502 of the resilient bar element 50 so that the hooked tip 503 can move in the track 703 and be retained therein. Moreover, the two raised rails 701 are bilaterally provided with channels configured for receiving the springs 60 so that the springs 60 can be stretched and compressed in the channels, respectively.

Figure 8:
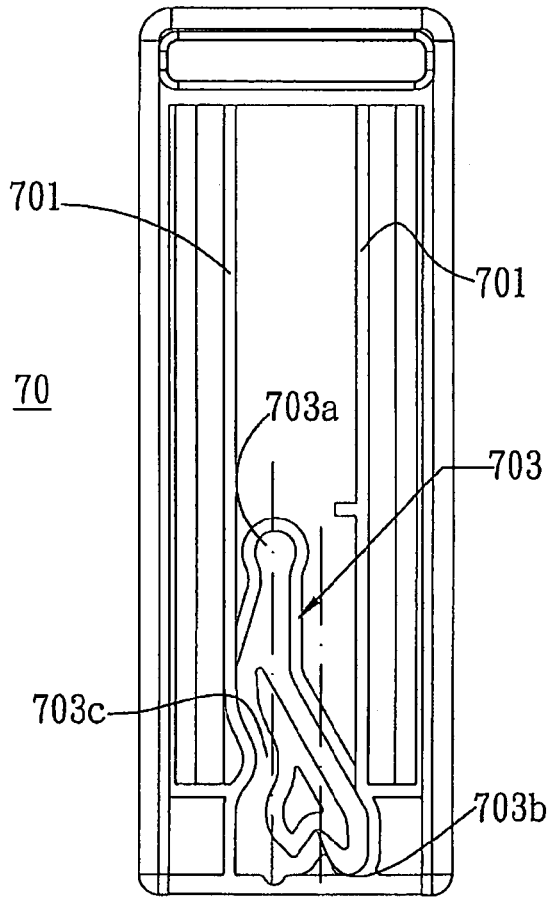
FIG. 8 is a top view of the railed housing according to the present invention.

As shown in FIG. 8, the track 703 of the railed housing 70 has a starting portion 703*a*, which is extended in an oblique direction and turns backward and then outward so as to form a retaining portion 703*b*. The retaining portion 703*b* leads back to the starting portion 703*a* after passing through a curved portion 703*c* halfway.

Referring again to FIG. 2, the resilient bar element 50 is made of a resilient material and formed as a resilient bar 502. The resilient bar 502 has a front end bent into the hooked tip 503 and a rear end bent into the insertion portion 501.

Figure 9:
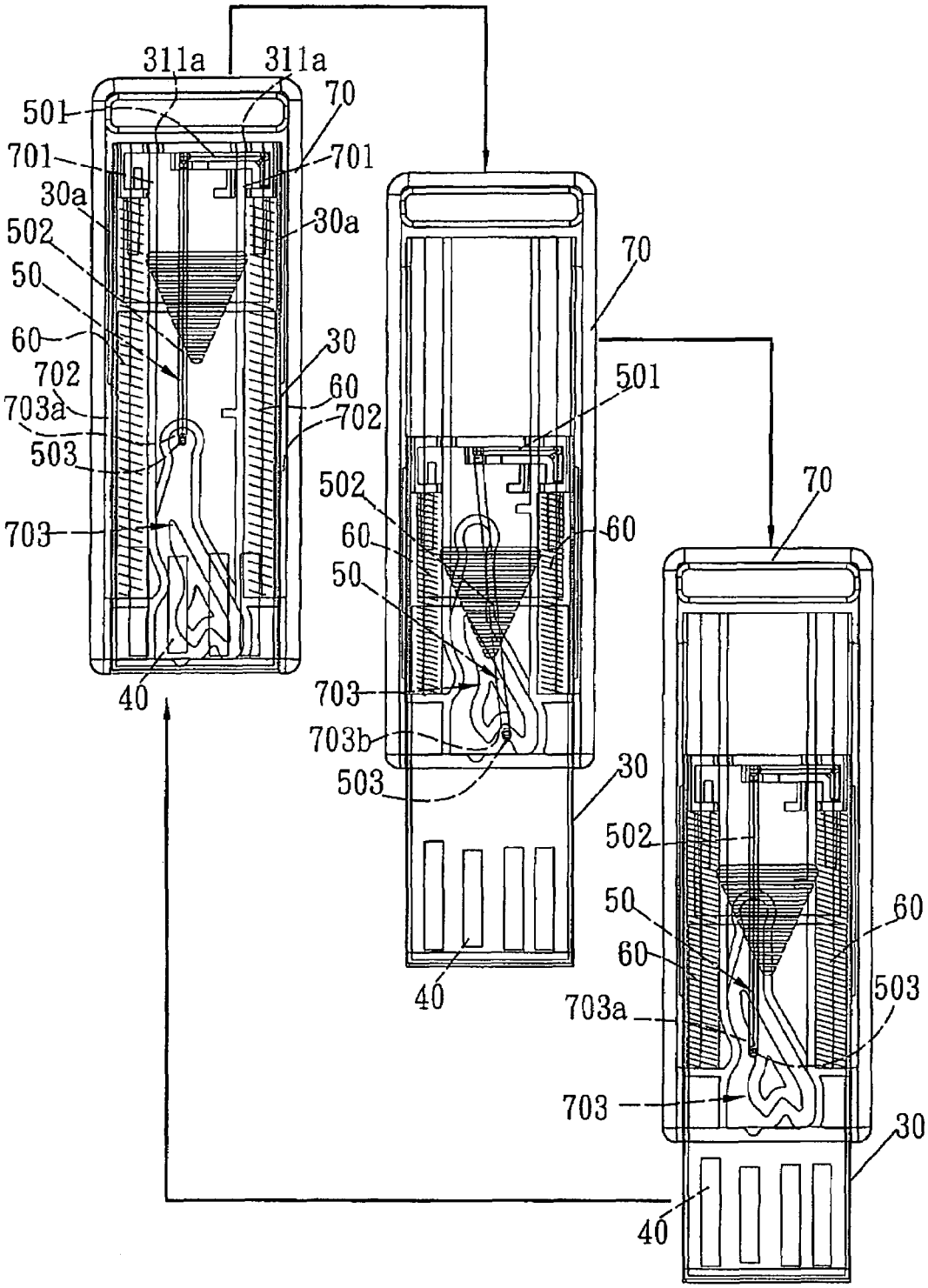
FIG. 9 is a series of see-through views showing operation of the improved USB connector extension/retraction device for a USB flash drive according to the present invention.

FIG. 9 provides a series of see-through views showing operation of the improved USB connector extension/retraction device for a USB flash drive according to the present invention. As shown in the upper left drawing of FIG. 9, the hooked tip 503 at the front end of the resilient bar 502 of the resilient bar element 50 is located at the starting portion 703*a* of the track 703 of the railed housing 70. When the moving cover 30 is pushed forward, the resilient bar element 50 is driven forward along with the flash memory unit 40 so that the springs 60 are compressed. As a result, the hooked tip 503 at the front end of the resilient bar 502 of the resilient bar element 50 advances along the track 703 into the inwardly curved retaining portion 703*b* and is retained thereby, as shown in the middle drawing of FIG. 9. Meanwhile, a USB connector of the flash memory unit 40 at the front end of the moving cover 30 is extended out for insertion into a computer. When the USB connector of the flash memory unit 40 is no longer in use, and it is desired to retract and hide the USB connector for protection, the moving cover 30 is pushed forward once more, thereby driving the hooked tip 503 at the front end of the resilient bar 502 of the resilient bar element 50 to advance and be released from the retaining portion 703*b*. Consequently, the resilient bar 502 of the resilient bar element 50 automatically and resiliently recovers to its original vertical state (原文「垂直狀態」文義不明). Meanwhile, the two springs 60 are also released from compression so as to generate a resilient restoring force that pushes the moving cover 30 back in place. As a result, the resilient bar element 50 and the flash memory unit 40 are drawn back simultaneously with the moving cover 30. It should be noted that the hooked tip 503 at the front end of the resilient bar 502 of the resilient bar element 50 will pass through the curved portion 703*c* of the track 703 before returning to the starting portion 703*a* so as to buffer the resilient restoring force of the springs 60, as shown in the lower right drawing of FIG. 9. Thus, the USB connector of the flash memory unit 40 is extended for use and retracted for protection while the USB flash drive equipped with the improved USB connector extension/retraction device of the present invention is allowed to have a reduced volume.

In short, the present invention achieves the intended effects and has never been put to public use. Thus, the present invention meets the requirements of utility and novelty for patent application, and an application for patent protection of the present invention is hereby lawfully filed for examination.

The invention claimed is:

1. A USB connector extension/retraction device for a USB flash drive, characterized by comprising:

a resilient bar element made of a resilient material and formed as a resilient bar having a front end bent into a hooked tip and a rear end bent into an insertion portion;

a moving cover having two sidewalls each protrudingly provided with a first raised rail, the moving cover further having a front end formed with a cavity for receiving a flash memory unit, wherein an insertion-based retaining unit is provided behind the cavity and has a rear end formed with two notches and a groove configured for being inserted by and in turn retaining the insertion portion of the resilient bar element, the insertion-based retaining unit being bilaterally provided with protruding posts for inserting into and thus retaining springs, respectively; and a railed housing internally formed with a recess and having two sidewalls each concavely provided with a recessed rail for engaging with a corresponding said first raised rail of the moving cover so that the first raised rails can move back and forth in the recessed rails, respectively, wherein the railed housing is protrudingly provided therein with two spaced second raised rails for engaging with the two notches of the insertion-based retaining unit of the moving cover so that the second raised rails can move back and forth in the notches, respectively, wherein a generally Y-shaped track is provided at a front end in between the two second raised rails and configured for guiding the hooked tip at the front end of the resilient bar of the resilient bar element so that the hooked tip can move in the track and be retained therein, wherein the two second raised rails are bilaterally provided with channels configured for receiving the springs so that the springs can be stretched and compressed in the channels, respectively;

wherein the track of the railed housing comprises a starting portion extended in an oblique direction and turning backward and then outward so as to form a retaining portion, the retaining portion leading back to the starting portion after passing through a curved portion halfway.

* * * * *